US008127472B2

(12) United States Patent
Kotila

(10) Patent No.: US 8,127,472 B2
(45) Date of Patent: Mar. 6, 2012

(54) ZERO CLEARANCE ATTACHMENT

(75) Inventor: Wayne Michael Kotila, Buffalo, MN (US)

(73) Assignee: Wayne M. Kotila, Buffalo, MN (US)

( * ) Notice: Subject to any disclaimer, the term of this patent is extended or adjusted under 35 U.S.C. 154(b) by 0 days.

(21) Appl. No.: 12/657,643

(22) Filed: Jan. 25, 2010

(65) Prior Publication Data

US 2010/0186267 A1 Jul. 29, 2010

Related U.S. Application Data

(60) Provisional application No. 61/205,943, filed on Jan. 26, 2009.

(51) Int. Cl.
*E01H 5/04* (2006.01)

(52) U.S. Cl. ..... 37/281

(58) Field of Classification Search ..... 37/266, 37/219, 280, 281, 283, 272–274, 229, 275, 37/279; 172/810–817, 271, 430, 265, 269; 404/101, 104

See application file for complete search history.

(56) References Cited

U.S. PATENT DOCUMENTS 3,279,104 A 10/1966 Wandscheer
3,604,517 A 9/1971 Clifford
3,805,424 A 4/1974 Renahan
3,807,064 A 4/1974 Schmidt, Jr.
4,073,076 A * 2/1978 Fortune ..... 37/266
4,073,077 A 2/1978 Essel
4,077,139 A * 3/1978 Fagervold et al. ..... 37/280
4,145,825 A 3/1979 Bertulino
4,275,514 A 6/1981 Maura
4,741,116 A 5/1988 Engle
4,962,600 A 10/1990 Zellaha
5,148,617 A 9/1992 Feller
5,638,618 A 6/1997 Niemela
5,815,957 A * 10/1998 McKeown ..... 37/280
6,347,465 B1 * 2/2002 Jensen ..... 37/280
7,100,314 B1 * 9/2006 Jensen ..... 37/281

* cited by examiner

*Primary Examiner* — Robert Pezzuto

(57) ABSTRACT

A device that allows safe and complete clearing of snow or other material away from obstacles such as, buildings, doors, vehicles, machinery, etc. The device attaches to and guides material into a plow, bucket, blower, snow blower, or other equipment allowing the machine operator to physically contact an obstacle being cleared around without causing harm or damage to the obstacle. The soft moveable flex edge of the device can touch and slide along the obstacle allowing more complete snow or other material removal. The flex edge can deflect back and away from an obstacle preventing damage to the obstacle. The device comprises a rigid frame with a flex edge on the outward end of the frame. The flex edge can embody many designs including but not limited to, a spring resistance deflection mechanism, a pivot mechanism or a retracting mechanism.

9 Claims, 7 Drawing Sheets

ZERO CLEARANCE ATTACHMENT

CROSS REFERENCE TO RELATED APPLICATION

This application claims the benefit of provisional patent application 61/205,943 filed 26 Jan. 2009 by the inventor Wayne M. Kotila

BACKGROUND OF THE INVENTION

1. Field of Invention

The present invention relates to the safe and complete removal of snow, sand, or other materials away from and right up against doors, buildings, or other obstacles. The invention addresses the issue of snow or other material removal being limited to areas a safe distance away from buildings and other obstacles, resulting in snow and other materials left up against buildings, doors and other obstacles. This can result in the need to step over, climb over, or hand shovel the material away, but in many cases the material is just left where it is. This often results in stuck vehicles, loss of access, or doors frozen down, and snow left piled up can create ice dams, which can cause water to back up into buildings.

The invention can be quickly attached or removed when needed, or remain mounted all the time to a bucket, plow, blade, blower, snow blower, or other equipment, and can be designed to attach to either end of the bucket, plow, blade, blower, snow blower, or other equipment. The invention can be used to clear away unwanted material from buildings, doors, or other obstacles and into the bucket, plow or blade with no resulting damage. The invention can fit a variety of applications through a variety of designs and through a variety of flex edge designs. The invention has a proportionally small size in comparison to most of the plows, blades, buckets, blowers, snow blowers or other equipment, it would attach to. Because of this small proportional size the invention won't create a strong side force on the machine being used to clear away material.

2. Description of Prior Art

As can be seen by reference to the following U.S. Pat. Nos. 4,145,825: 3,604,517:3,279,104: 3,805,424: 4,275,514: 3,807,064: 4,073,077: 5,638,618: 5,148,617: 4,962,600: 4,741,116. There are a myriad, and diverse number of wing or extension constructions that serve to extend the width of a plow blade or bucket and, or to prevent a trail of snow or other material from sliding off the end of a bucket or blade, but none that address the issue of complete clearing of unwanted material away from buildings, doors, and other obstacles. Prior art does not allow for physical contact between the plow blade or bucket extension and the obstacle, and if said contact did take place, severe damage to the obstacle could and would result. The current invention: Zero Clearance Attachment, is designed to solve these issues, while not causing damage to the obstacles being cleared around thus providing more complete snow or other material removal.

SUMMARY OF THE INVENTION

The present invention, the Zero Clearance Attachment allows for the safe removal of snow and other material up to and against buildings and other obstacles, without causing damage to the buildings or other obstacles. Prior art does not allow for close up material removal, and attempting to get close can result in severe damage to buildings or other obstacles. The Zero Clearance Attachment can be of a variety of different designs and materials, without changing the intent of the invention.

In one embodiment, a flexible (flex) edge or soft edge is used, in another embodiment the flex edge is enhanced with a customizable spring tension design using compression springs to add resistance. These compression springs can be changed in minutes to weaker or stronger springs to fit the users desired parameters. In other embodiments the use of springs, pivot plates or retracting plates and or a soft or flex edge are used.

The inventions many different designs, all use a strong frame forming an angle with gussets or other framing for strength, the angle can be any degree of bend to fit the desired application. The frame can be quickly attached to the end of a plow blade, bucket snow blower, or other applicable device. The inventions flex edge can be of a stiff yet forgiving material such as rubber or other applicable materials known to industry. The inventions embodiment of a flex edge can also be constructed of a forgiving but stiff material like belting, and the belting can be wrapped around a pipe or other material to add more rigidity, while still maintaining a flexible edge that will deflect away if striking a building or other obstacle and not cause any damage. The pipe or other rigid material used also provides a mounting frame for attaching a square tubing or other suitable receiver for the compression spring assembly. In this assembly the ends of the compression spring rods float unattached in over sized holes in the square tubing, and can be assembled with extension springs that run between the spring rods and the square tubing. This prevents the floating spring rods from popping out of the receiver (square tubing), if the flex edge is deflected forward, as this can happen from the forces applied if a plow blade is dragging on the ground as it is angled back.

The many designs of the The Zero Clearance Attachment, allow it to work with a variety of machines and applications while maintaining the same design intent.

BRIEF DESCRIPTION OF DRAWINGS

The present invention will be further explained with references to the drawing figures listed below, where in like structure is referred to by like numerals throughout the multiple views.

A: The belt style flex edge looped around a rigid pipe.

B: The compression spring resistance assembly.

Figure 3:
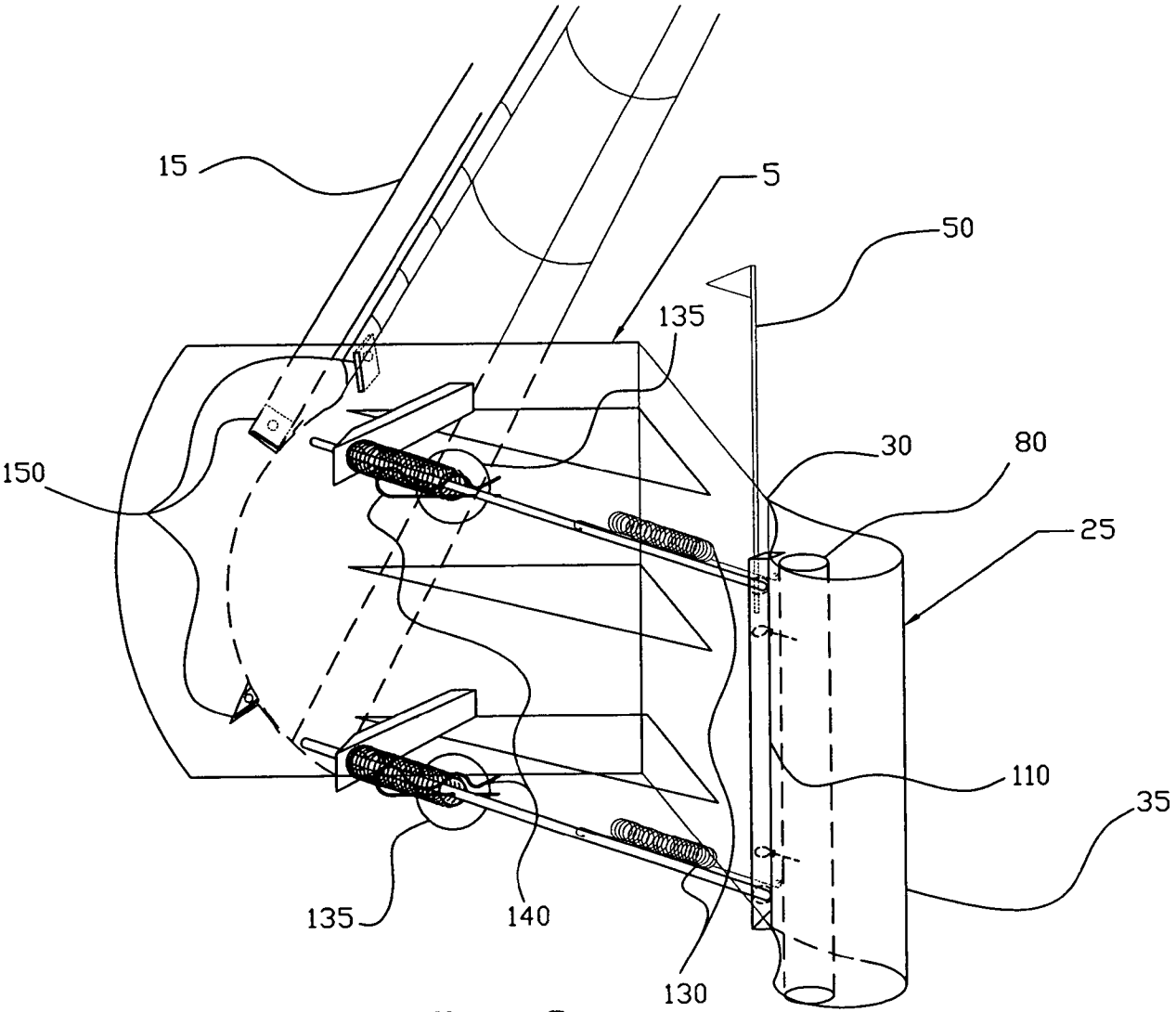

FIG. 3 is a perspective view of the ZCA mounted to a blade or plow designed with the following embodiments.

A: The belt style flex edge looped around rigid pipe.

B: The compression spring resistance assembly with extension spring rod holders.

Figure 4:
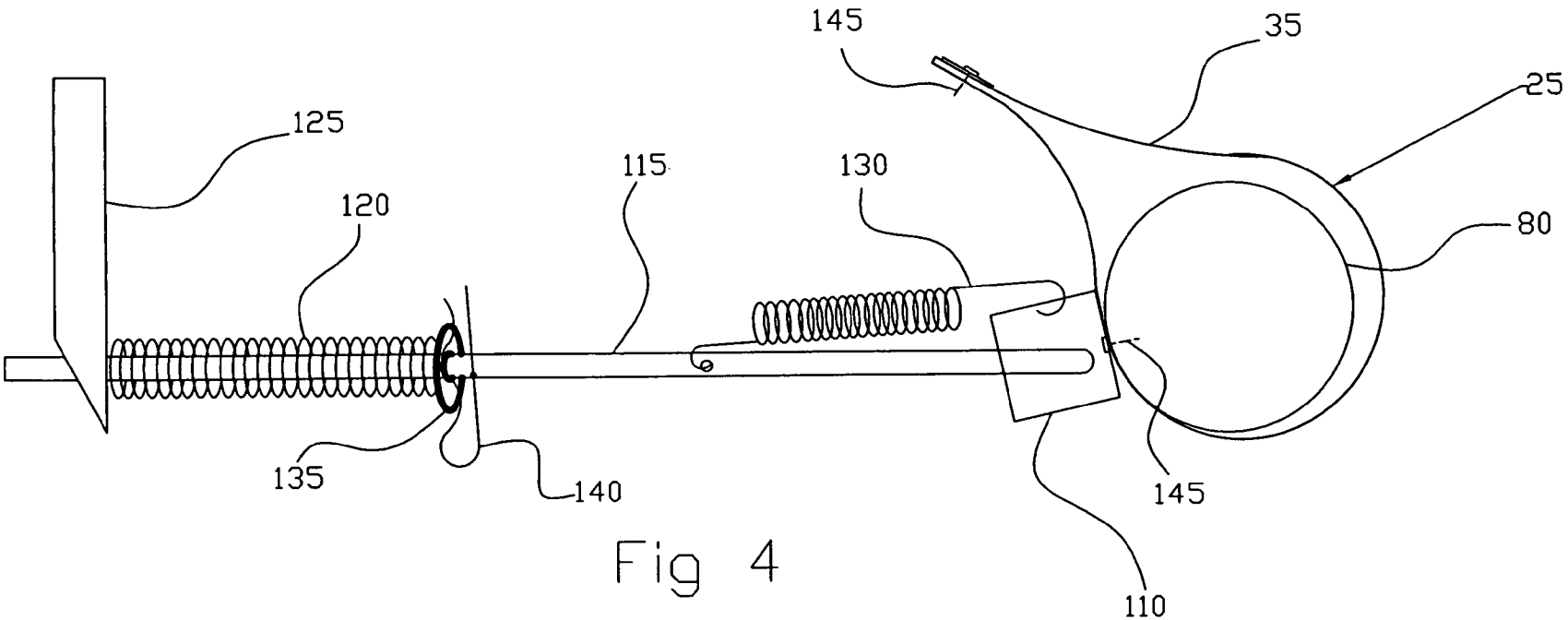

FIG. 4 is a top view of the compression spring resistance assembly with an extension spring rod holder and a belt style flex edge looped around a rigid pipe.

Figure 5:
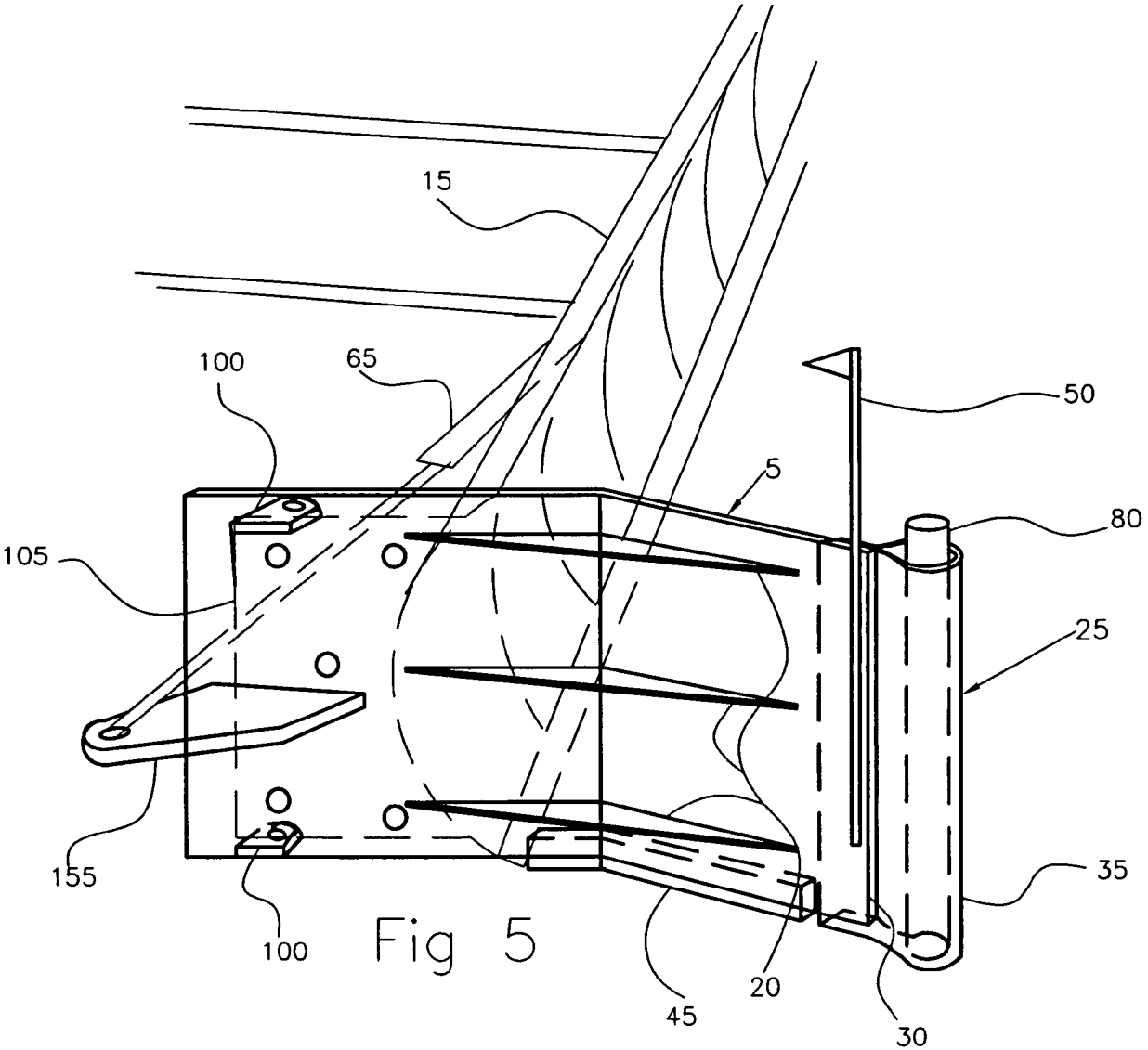

FIG. 5 is a perspective view of the ZCA mounted to a blade with a belt Style flex edge looped around a rigid pipe, designed with a pivot mechanism to pivot the ZCA back out of the way to a park position when desired.

Figure 6:
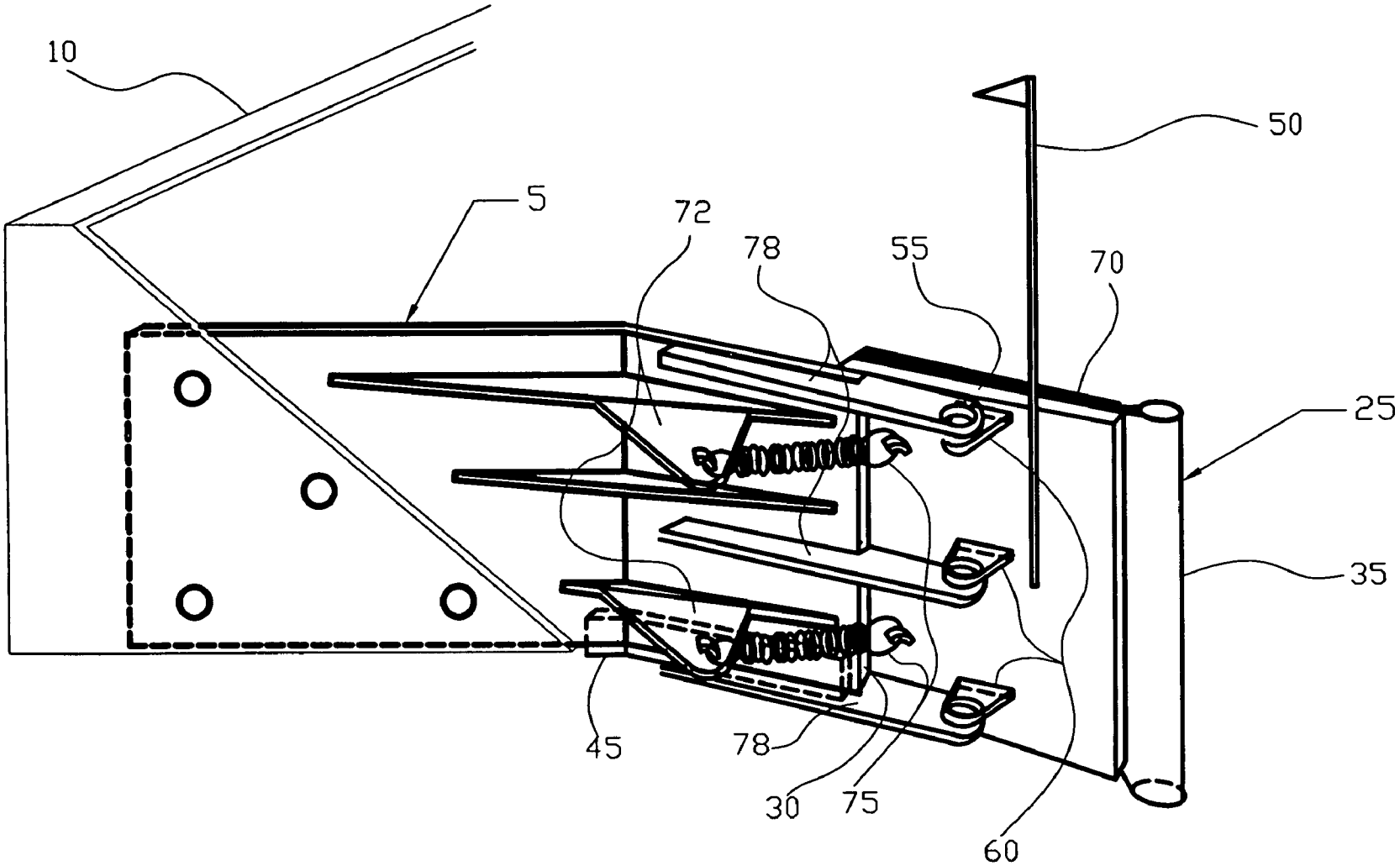

FIG. 6 is a perspective view of the ZCA mounted to a bucket designed with a pivoting flex plate and a looped belt style flex edge.

Figure 7:
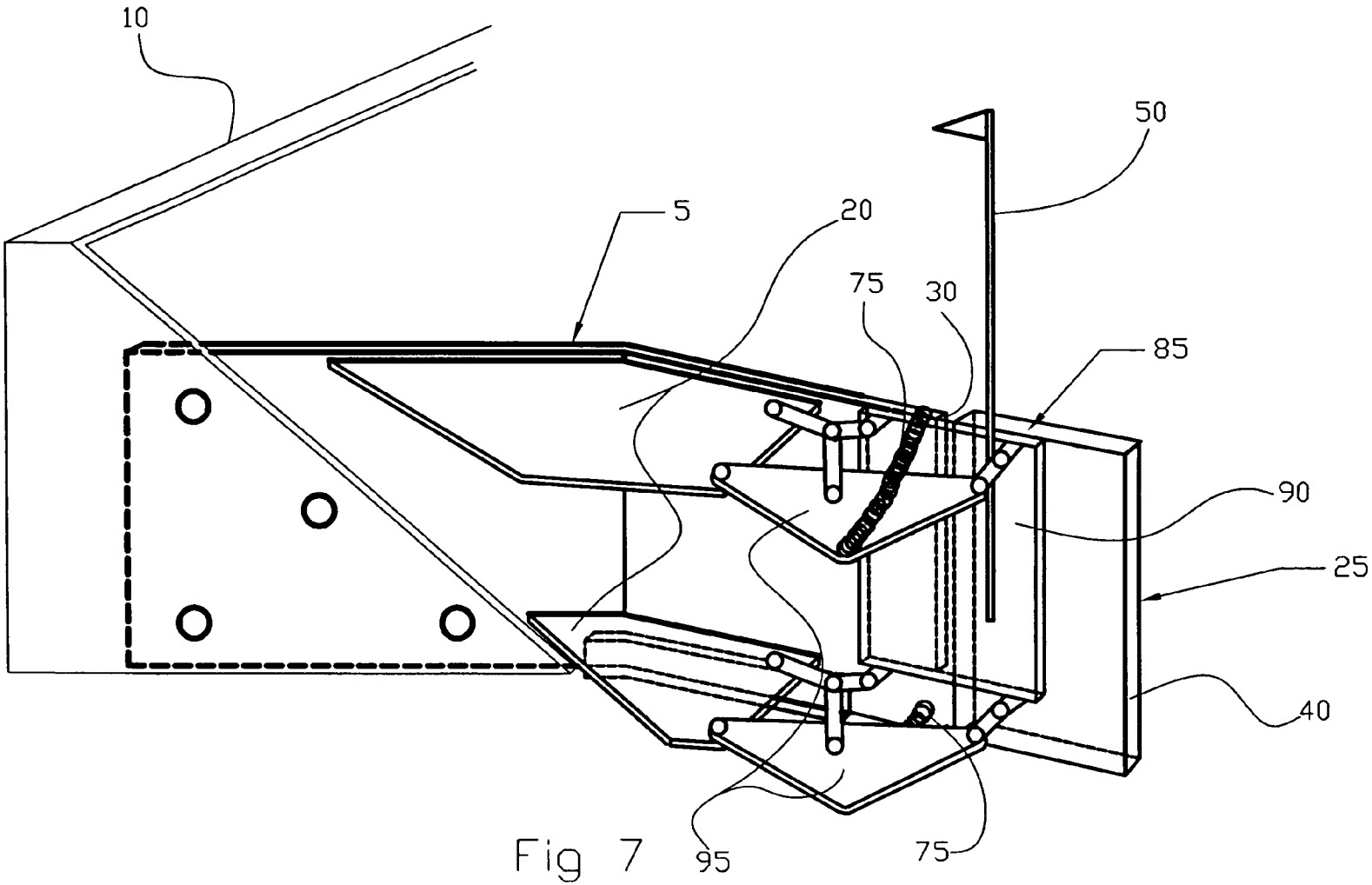

FIG. 7 is a perspective view of the ZCA mounted to a bucket designed with a retractable flex plate and a flex edge of a solid but forgiving and flexible material like rubber.

While the above identified drawing figures set forth a variety embodiments of the invention, other embodiments are also contemplated as noted in the discussion. In all cases, this disclosure presents the present invention by way of representation and not limitation. It should be understood that numerous other modifications and embodiments can be devised by those skilled in the art which fall within the scope and spirit of the principles of this invention.

DETAILED DESCRIPTION OF THE PREFERRED EMBODIMENTS

Figure 1:
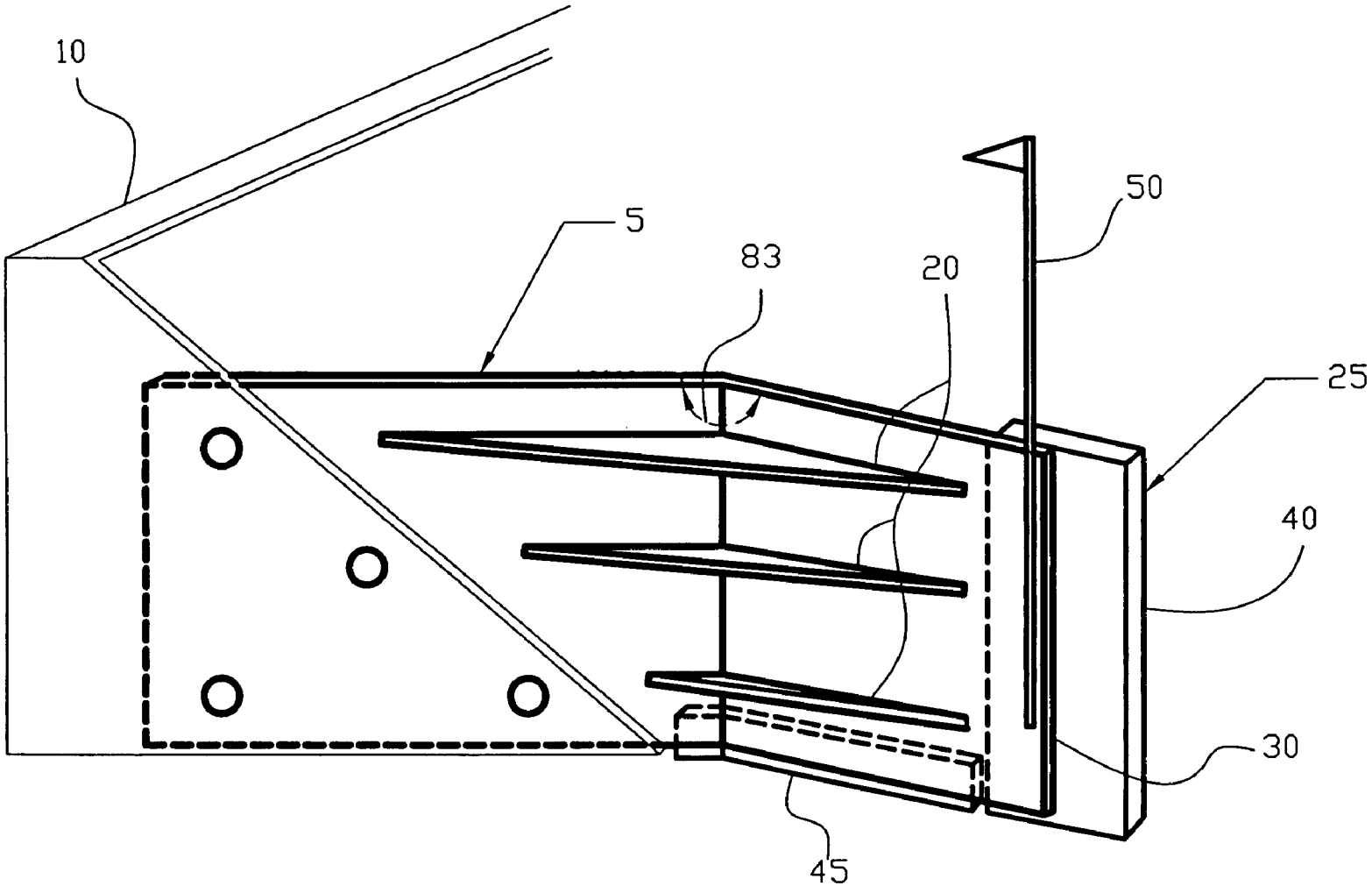
FIG. 1 is a perspective view of The Zero Clearance Attachment (ZCA) with a solid flex edge (i.e. rubber), the ZCA is mounted to a bucket.

FIG. 1 in this embodiment of the present invention, The Zero Clearance Attachment (ZCA) (5) is a frame or structure and is designed for use with a conventional bucket (10). The ZCA (5) attaches to the bucket (10) with bolts, pins, welding or other preferred method. The ZCA (5) is attached to the end of the bucket (10) and angling away at an angle (83) of 45 degree, but could be of a lesser or greater degree of angle and not change the design intent. This angle (83) is supported by gussets (20) to maintain the angle (83) and add rigidity, the gussets (20) are attached (i.e. welded) to the ZCA (5). On the outward vertical end (30) of the ZCA (5) is a flexible (flex) edge (25). This flex edge is of a solid yet flexible material like rubber (40). The bottom edge of the ZCA (5) has a height adjustable and replaceable wear edge (scraper blade (45)), attached by suitable means such as bolts. The scraper blade (45) accounts for the thickness of the bucket (10), aligning the bottom of the ZCA (5) with the bottom of the bucket (10) when the ZCA is mounted inside the bucket (10). The ZCA (5) has a location indicating pole (50) mounted to the outward vertical end (30) of the ZCA (5), this indicates to the machine operator, the location of the vertical edge (30) of the ZCA (5) in order to maintain contact between the flex edge (25) and the obstacles being cleared around when needed.

Figure 2:
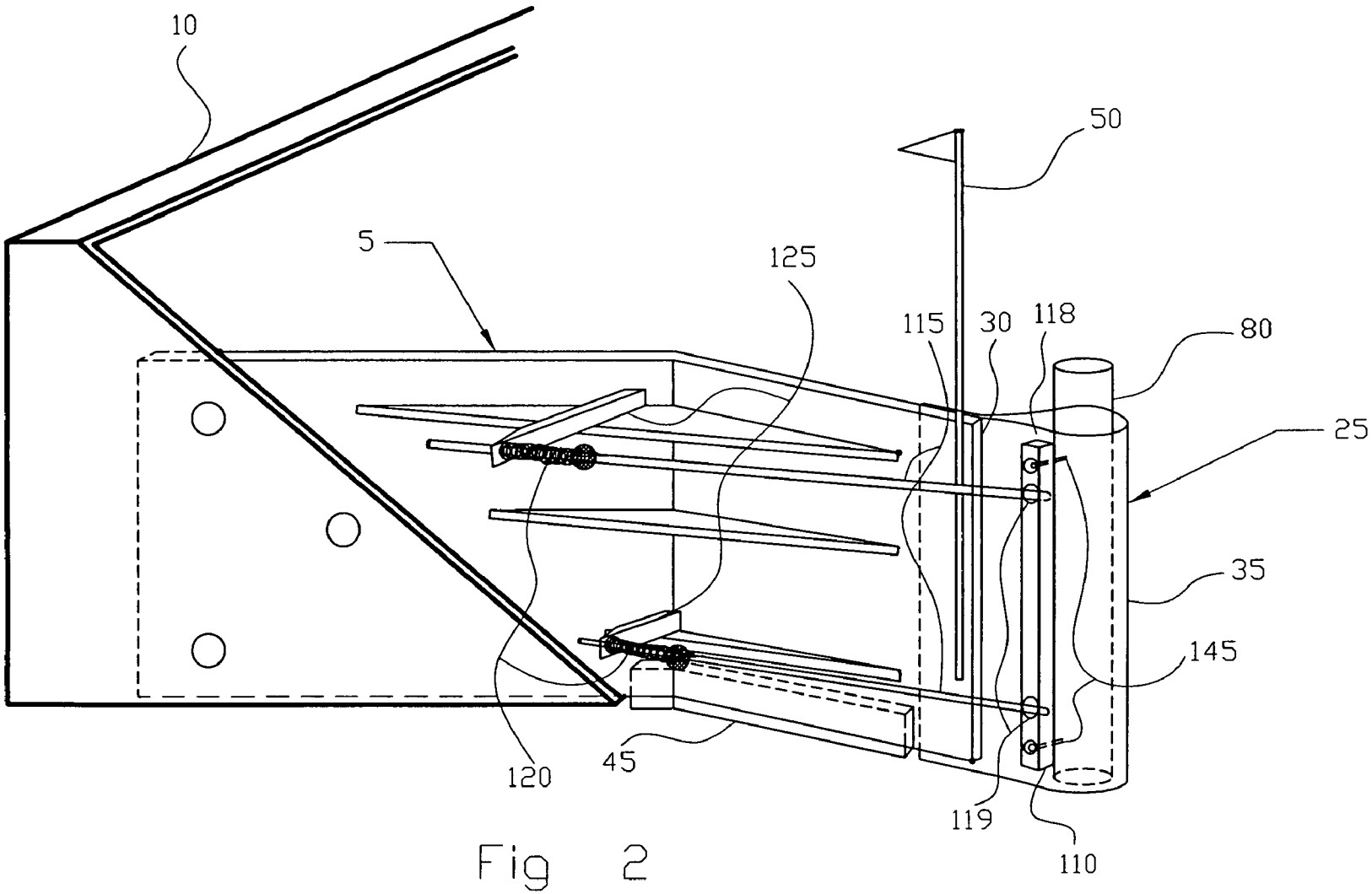
FIG. 2 is a perspective view of the ZCA mounted to a bucket and designed with following embodiments.

FIG. 2 in an alternate embodiment the ZCA (5) is attached to a conventional bucket (10) with bolts, pins, welded or by whatever means preferred. The ZCA (5) has a flex edge (25) constructed of belt material (35) looped around a rigid pipe (80), and attached to the outward vertical end (30) of the ZCA (5). The ZCA (5) also has a flex edge location indicating pole (50), as well as an adjustable and replaceable scraper blade (45). The ZCA (5) angles outward at an angle (83) of 45 degree, or can be a lesser or greater angle if desired. This angle (83) is maintained with gussets (20) that are attached (i.e. welded) to the ZCA (5). In this view the ZCA (5) has a compression spring resistance assembly that includes compression springs (120) riding on compression spring rods (115), with one end of the compression spring rods (115) floating in oversized holes (pockets (119)), through one wall of the compression spring rod receiver (tube or square tubing (110)). This receiver tube (110) is attached to the backside (118) of the flex edge (25) with screws, bolts, rivets or other applicable means through the belting (35) and into the rigid pipe (80). The opposite end of the compression rods (115) slide loose through holes in the compression spring brackets (125). The compression springs (120) ride on the compression spring rods (115) and are held between the compression spring brackets (125) and flat washers (135), (as shown in more detail in FIG. 4). The compression spring brackets (125) are attached to the ZCA (5) by applicable means (i.e. welding). When using the ZCA (5) this tension spring resistance assembly gives the flex edge (25) more rigidity, this added and customizable rigidity allows the clearing of harder materials like icy snow but if the flex edge (25) strikes an obstacle such as a building, the flex edge (25) will still deflect back and inward as the compression springs (120), compress between the compression spring brackets (125), and the flat washers (135). The compression springs (120) can be easily and quickly changed to stronger or weaker tension springs to fit the desired parameters.

FIG. 3 the embodiment in this version of the ZCA (5) is attached to a conventional plow (15) by means of mounting tabs (150), and common fasteners like pins or bolts. The ZCA (5) is forming a angle (83) with a plow mounted application the angle (83) can usually be anywhere from 0 degrees to 120 degrees because of the plows ability to be held at varied angles, but the preferred angle would be between 45 degrees, and 90 degrees. The ZCA (5) is strengthened with gussets (20). The flex edge (25) is a looped belt (35), with a rigid pipe (80), and has a spring resistance assembly using compression springs (120) (as described in FIG. 2). The embodiment in FIG. 3 also utilizes extension springs (130) attached to the compression spring rods (115) and the compression spring rod receiver (110). The extension springs (130) ensure that the ends of the compression spring rods (115) do not pop out of the holes in the compression spring rod receiver (110). This can happen when the flex edge (25) deflects forward as the plow angle is changed in a clockwise direction, (with a ZCA that mounts on the right end of the plow) and the plows bottom edge is dragging on the ground. The ZCA (5) in this view also has a location indicating pole (50).

FIG. 4 is a larger top view of the spring resistance assembly, consists of a compression spring bracket (125), compression spring rod (115), compression spring (120), flat washer (135), cotter pin (140), compression spring rod receiver (110), rod holding extension spring (130), flex edge (25), looped belt material (35), rigid pipe (80), and fasteners (145). When clearing away snow or other material with The Zero Clearance Attachment, with the flex edge moving along a building door or other obstacle, the compression springs (120) of the compression spring resistance assembly will give added resistance to the flex edge (25), allowing heavier, harder or denser material to be removed, but the flex edge (25) will still deflect back compressing the compression springs (120) if the obstacle being cleared around or some other obstacle like the edge of a door frame is hit with the flex edge (25). This allows for complete clearing of material up against obstacles with out damaging the obstacle. When the flex edge (25) deflects back from an obstacle, the compression rod (115) with be pushed back by the compression spring receiver (110), the flat washer (135) held in place by the cotter pin (140), will compress the compression spring (120) up against the compression spring bracket (125). The compression springs (120), can be interchanged with stronger or weaker springs to give more or less flex edge resistance if desired. If needed for the application a compression rod holding extension spring (130) will keep the compression spring rod (115) from coming out of the hole in the compression rod receiver (110). In all applications the flex edge (25) can be used without the compression spring resistance assembly if the added flex edge resistance given by the compression springs (120) is not needed.

FIG. 5 shows the ZCA (5) attached to a conventional plow (15), in this embodiment the ZCA (5) would attach with a pivoting system. The inward facing side of the ZCA (5) has pivot point brackets (100), that align with mating pivot points on a mounting plate, or frame (105), and this mounting plate, or frame (105) would be attached to the plow (15), and the ZCA would attach to the plate or frame (105), via the pivot points using pins or bolts. This would allow the ZCA (5) to rotate, (pivot) around and to a parked position in back of the plow (15) or other device, that the ZCA (5) is mounted to. With pivot points (100) on the inward side of the ZCA (5) and the pivot arm (155) on the outward side, when the cylinder (65) is retracted, the ZCA (5) will pivot around and back. In lieu of the cylinder (65) a manual linkage or other known means could be used. The embodiment in FIG. 5 forms an angle (83) with frame work or gussets (20), has a flex edge (25), a location indicating pole (50), and an adjustable scraper blade (45), mounted to the bottom. The flex edge (25) is a looped belt (35) around a rigid pipe (80) that is riveted, screwed, bonded or by other applicable means attached inside the looped belt (35).

FIG. 6 is a ZCA (5) attached to a conventional bucket (10) with bolts, pins, welded or by whatever means preferred. In this embodiment the ZCA (5) has a flex edge (25), made with looped belt material (35) and attached to a pivoting plate (55) constructed of a rigid material like steel. The pivoting plate (55) has pivot tabs (60), that with pivot pins attach to pivot plate brackets (78). The Pivot plate brackets (78), are attached (i.e. welded) to the main frame of the ZCA (5). The pivot plate (55) has a location indicating pole (50). Extension springs (75) connected between spring connection brackets (72), and pivot plate (55) keep the pivot plate (55) in the home position. The ZCA (5) uses gussets or support brackets (20), to add rigidity and maintain the angle (83). Along the bottom is an adjustable scraper blade (45). The face or leading side of the pivot plate (55) has a soft face (70) of rubber or other suitable material. In addition to the flex edge (25), deflecting to the rear and inward when striking an obstacle, the pivot plate (55) can also pivot back giving a large safe area to strike and obstacle with out causing damage to the obstacle. The pivot plate (55) can be easily modified with stronger or weaker springs (75) to change the force required to pivot the plate.

FIG. 7 is a ZCA (5) attached to a conventional bucket (10). In this embodiment the flex edge (25) is of a solid material like rubber (40) and is attached to a retracting plate (90) that can be made of a rigid material like steel, that will retract back and inward away from an obstacle when striking the obstacle. This is accomplished through the retracting linkage (95). The extensions springs (75) will return the retracting plate assembly (85), to its home or normal position after clearing the obstacle. There is an adjustable scraper blade (45) along the bottom of the ZCA (5), there are gussets or framing (20), to give rigidity and maintain the angle (83) of the ZCA (5). In this view the gussets (20) are used as a connection point for the retracting linkage (95) of the retracting plate assembly (85). There is a location indicating pole (50) on the retracting plate assembly (85). With this design the retracting plate (90), along with the flex edge (25) gives a large safe area to strike an obstacle without causing damage to the obstacle. The flex edge (25) will deflect to the rear and inward when striking an obstacle and the retracting plate (90) will also retract to the rear and inward toward the main frame of the ZCA (5), and away from the obstacle being struck. The extension springs (75) can easily be changed to stronger or weaker springs to modify the force required to retract the retracting plate assembly (85).

REFERENCE NUMERALS IN DRAWINGS

5. Zero Clearance Attachment (ZCA)
10. Bucket (for reference)
15. Plow blade (for reference)
20. Gusset
25. Flex edge
30. Outward edge of ZCA frame
35. Belt material
40. Solid rubber
45. Scraper blade
50. Location indicating pole
55. Pivoting plate
60. Pivot point tabs
65. Cylinder
70. Soft face material
72. Spring connection bracket
75. Extension springs
78. Pivot plate bracket
80. Rigid pipe
83. Angle
85. Retracting plate assembly
90. Retracting plate
95. Retracting linkage
100. Pivot point brackets
105. Mounting plate
110. Compression spring rod receiver
115. Compression spring rod
118. Backside
119. Pockets
120. Compression spring
125. Compression spring bracket
130. Compression rod holding extension spring
135. Flat washer
140. Cotter pin
145. Fastener
150. Mounting tabs
155. Pivot arm

I claim:

1. An apparatus for use in combination with a frame of plow blade or bucket, the plow blade or bucket having at least one side member extending substantially perpendicular to a face of the blade or bucket;

the apparatus comprising a plate removably mounted to the side member of the blade or bucket wherein the plate further comprises two portions, a first portion having a plurality of connection means therethrough; and, a second portion extending at an angle approximately forty five degrees from the first portion; the second portion further having a third member extending therefrom and pivotable relative to the second portion about a substantially vertical axis; and, a resilient mechanism comprising at least one extension/compression spring extending between the first and second portions and the third member wherein the extension/compression spring hold the third member substantially parallel to the second portion until resiliently struck by an obstacle.

2. The apparatus of claim 1 wherein said angle is supported or strengthened with gussets or braces.

3. The apparatus of claim 1 wherein said plate forms an angle that can vary between 0 and 85 degrees.

4. The apparatus of claim 1 wherein the apparatus further comprises a wear edge that is adjustable and replaceable and is attached to a bottom edge.

5. The apparatus of claim 1 wherein the third member further comprises a flexible edge which is capable of yielding when contacting or striking said obstacle.

6. The devise apparatus of claim 5 where in said flexible edge is comprised of a solid material that can yield or flex.

7. The device apparatus of claim 5 wherein said flexible edge is comprised of a soft flexible material and or belt material looped for added rigidity.

8. The apparatus of claim 5 further comprising: a position indicating pole which provides a visual indication to an operator when contacting or striking said obstacle.

9. The apparatus of claim 8 wherein said flexible material or said belt material is looped with an elongated member in order to provide additional rigidity to said flexible edge.

* * * * *